US005400683A

United States Patent [19]

LaFlame

[11] Patent Number: 5,400,683

[45] Date of Patent: Mar. 28, 1995

[54] CARRIER FOR PERCUSSION INSTRUMENTS

[76] Inventor: Thomas R. LaFlame, 24 McMonagle Ave., Pittsburgh, Pa. 15220

[21] Appl. No.: 260,770

[22] Filed: Jun. 16, 1994

[51] Int. Cl.[6] ..... G10D 13/02

[52] U.S. Cl. ..... 84/421; 224/265; 224/910

[58] Field of Search ..... 84/421; 224/209, 210, 224/211, 262, 265, 910

[56] References Cited

U.S. PATENT DOCUMENTS

| | | | |
|---|---|---|---|
| 4,387,839 | 6/1983 | Dranchak | 224/265 |
| 4,402,441 | 9/1983 | Jones et al. | 224/265 |
| 4,453,442 | 6/1984 | LaFlame | 84/421 |
| 4,605,144 | 8/1986 | LaFlame | 224/265 |
| 4,634,032 | 1/1987 | LaFlame | 224/265 |

*Primary Examiner*—Michael L. Gellner
*Assistant Examiner*—Patrick J. Stanzione
*Attorney, Agent, or Firm*—Clifford A. Poff

[57] ABSTRACT

A carrier worn by a person to support a percussion instrument includes an abdominal plate having a load transferring surface swept with a curvature to extend along a part of the waist-line of such a person. A unitary frame is formed with a front portion continued by an elevating side portion to an upstanding rear portion. The front portion is rigidly joined to the abdominal plate and a back pressure plate is pivotally supported by a clevis assembly on the upstanding rear portion for imparting to the thoracic back region of the person some of the weight of a percussion instrument. Some of the forces are also imparted to the shoulders of a person by shoulder bars pivotally connected by clevis assemblies to the back pressure plate.

21 Claims, 4 Drawing Sheets

CARRIER FOR PERCUSSION INSTRUMENTS

BACKGROUND OF THE INVENTION

1. Field of the Invention

The present invention relates to a carrier of the type which is designed to be worn by a person while seated, standing, walking or marching to provide support and facilitate the play of a percussion instrument or instruments such as drums or the like. More particularly the present invention relates to such a carrier embodying a construction and relationship of parts to distribute reaction forces to the weight of a percussion instrument about the shoulders, thoracic region about the back and abdominal area of a person to prevent fatigue, stress and strain normally encountered by a percussionist while performing as part of a marching unit.

2. Description of the Prior Art

As is known in the art, a carrier for a percussion instrument generally takes the form of a frame-like structure that is suspended from the shoulders of a person by hooks or straps. The hooks engage with a T-shaped breastplate with a central leg extending to a riser attached to a belly plate. A carrier frame projects from the belly plate and any one of various forms of extension bars may be attached to the carrier frame for engaging the instrument or instruments. It is a common practice to use such a carrier to support one or more of a variety of instruments that notably consist of one or more percussion instruments. The instrument may comprise drums, marching bells, a xylophone, a vibraphone, a marimba, a timpani, chimes or the like. An example of such carrier is disclosed in U.S. Pat. No. 3,106,123.

Instead of hook members to engage the shoulders, a shoulder harness made up of straps that pass over the shoulders of a person, crossing in the back and passing forwardly below the arms at the sides of the person, can be used to support a drum which is also connected to a belly plate by other straps. Examples of this type of carrier are shown in U.S. Pat. Nos. 3,021,744 and 3,974,732. Another form of an instrument carrier is shown in U.S. Pat. No. 4,256,007 and comprises a rigid metal rod with bent portions forming a pair of spaced-apart loops for engaging the shoulder blades of a marcher and a cooperating integral bent portion adapted to contact the back of the marcher to suspend the carrier from the player's torso. A pair of arm members projects from the frame at the back of a person forwardly to support the percussion instrument. A releasable belt is coupled between the opposite sides of the frame to secure the carrier to the marcher.

Because of the fact that percussion instruments must be carried at an outwardly-extended position from the marcher's body, the shoulders and the lower back of the person carrying the instrument are particularly vulnerable to fatigue. The stress and strain due to the overhung load can be detrimental to the person carrying the instrument. In recent times, the number, weight and types of instruments that are carried have increased. For example, four and sometimes six drums are carried by an individual. Other instruments which are supported by carriers which hang on the marcher's body includes bells, a xylophone or a marimba, vibraphone, timpani and/or chimes which may have a weight of up to and sometimes exceeding 70 pounds. Sometimes an instrument or a group of instruments weighing more than 70 pounds must be carried. The weight of an instrument is applied to a marcher as a torque about the belly plate and forms a moment arm defined by shoulder straps or hooks. The marcher, almost inherently, shifts his or her lower torso forwardly as an offsetting measure to sustain the load produced by the overhanging weight. This causes fatigue in the lower lumbar region which the carrier of the present invention is designed to at least substantially eliminate.

In my earlier U.S. Pat. Nos. 4,453,442 and 4,605,144 there is disclosed a support for a percussion instrument in which a carrier frame was adapted to be worn by a percussionist by providing a rigid band that was attached to an abdominal plate and partly encircled the waistline of a percussionist to a point where there is provided an upwardly angled arm used to support a pressure pad for engaging the thoracic region at the back of the percussionist. This construction was advantageous because part of the weight to be sustained by the percussionist while playing the instrument appeared as a reaction force applied to the thoracic region of the back. The abdominal plate in one instance was used to additionally support a breast plate from which there extended shoulder hooks that passed from the front of the percussionist over the shoulders and terminated a short distance along the percussionist's back above the thoracic region of the back. The shoulder hooks were part of a rigidly bolted together structure including the abdominal plate and pressure pad to provide that the pad engaged the thoracic region of the back. This construction precluded distribution of forces between the thoracic region forces and abdominal region because of the rigidity of the structure and the inability to automatically position these parts relative to one another during movements by the percussionist. In another aspect of my earlier carrier design a cross bar extended from the rigid support for the pad at the thoracic region of the back. The cross-bar provided support areas for straps that could extend over the shoulders of the percussionist and engage with the abdominal plate. Because the pad could not assume a different angular relation with the abdominal plate in response to the movement of the percussionist, the loading on the body parts of the percussionist varied greatly depending on the position of the percussionist at any given time.

Accordingly, it is an object of the present invention to provide an improved carrier for a percussion instrument to alleviate the shortcomings and disadvantages of prior art carriers as discussed above hereinbefore.

It is a further object of the present invention to provide an improved carrier to be worn by a person for supporting a percussion instrument or the like wherein an abdominal plate and back pressure plate are connected together in a pivotal relationship to establish a uniform load bearing contact between the face surface area of the back plate and the thoracic region of the back through the use of the abdominal plate as a fulcrum for the load applied to the percussionist by the percussion instrument and including the carrier.

It is still a further object of the present invention to provide an improved carrier to be worn by a person for supporting a percussion instrument or the like wherein an abdominal plate, thoracic pressure plate and shoulder bars are connected together in a pivotal relationship to establish and control the distribution of forces on the percussionist's body without a concentration of forces at any one support site.

SUMMARY OF THE INVENTION

According to the present invention there is provided a carrier worn by a person to support a percussion instrument or the like, the carrier including the combination of an abdominal plate having a load transferring surface swept with a curvature to extend along a part of the waist-line of such a person, a unitary frame including a front portion continued by an elevating side portion to an upstanding rear portion, the front portion being rigidly joined to the abdominal plate, a back pressure plate for imparting to the thoracic back region of the person a reactive force in response to the weight of a percussion instrument imparted to the abdominal plate, and pivotal means interconnecting the back pressure plate and the upstanding rear portion of the unitary frame for forming a uniform load bearing contact between the face surface area of the back plate and the thoracic region of the back.

A further feature of the present invention provides that such a carrier further includes shoulder bar means pivotally connected to the back pressure plate for load bearing contact with a shoulder of such a person, and means linking the shoulder bar means to the abdominal plate for allowing distribution of the weight of the percussion instrument against the shoulder of such a person by the shoulder bar means and against the thoracic region by the back pressure plate.

The present invention additionally provides structure useful to form a drum mount for attaching a bass drum to the abdominal plate. For this purpose, there is provided upstanding support arms projecting to an elevation where a bass drum can be attached to the arms for use by the percussionist. The bass drum can be rotated by interposing a swivel between mounting blocks for the bass drum and a mounting plate associated with the upstanding support arms. A locking plate having index openings is situated between the swivel and the bass drum so that the index openings are exposed for receiving a locking tongue on a lock bar pivotally supported by the upstanding support arms and urged by a spring into engagement with one of the index openings.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
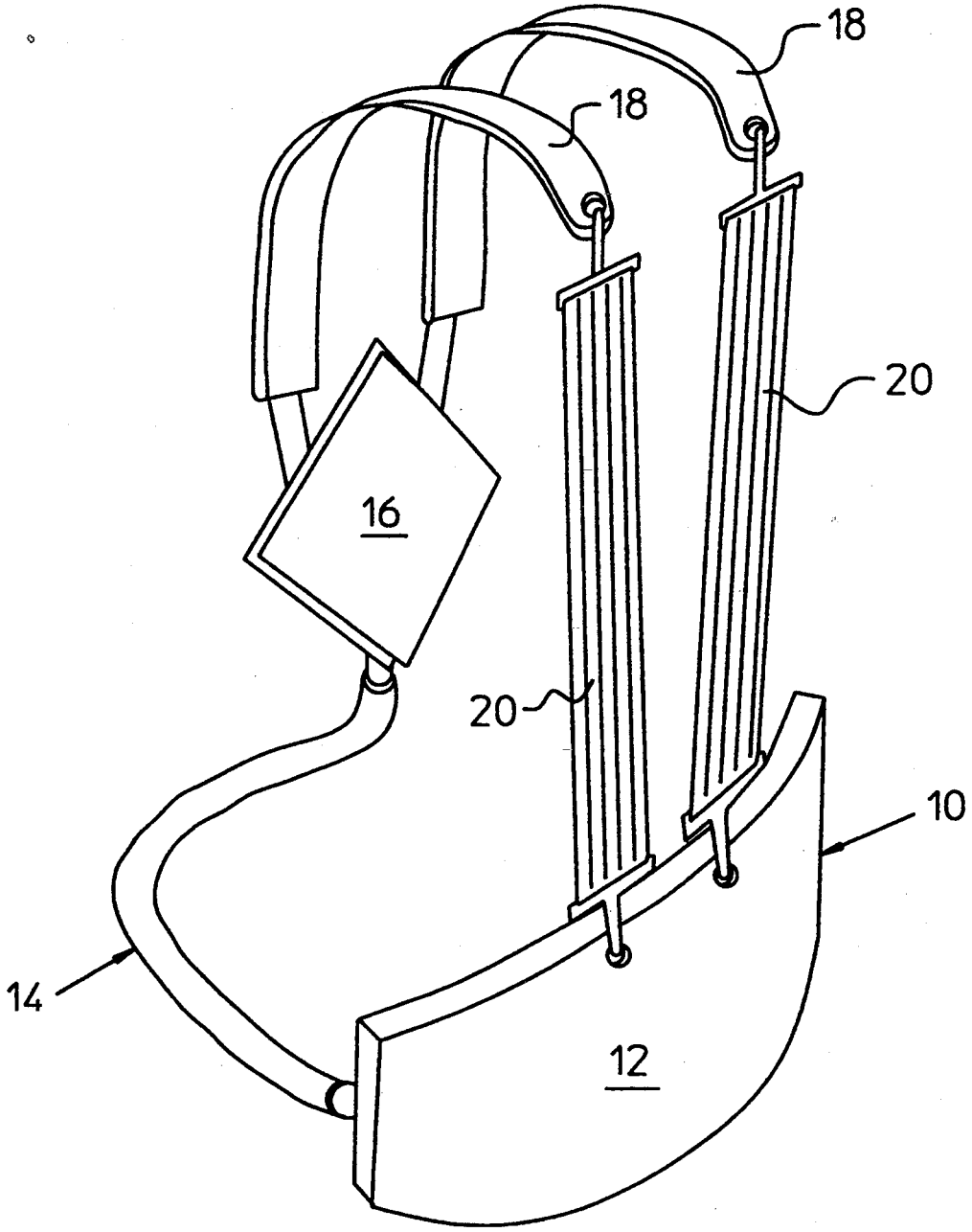
FIG. 1 is a perspective view of a carrier embodying the features of the present invention.

Turning now to FIG. 1 there is illustrated a carrier 10 that includes an abdominal plate 12 that is connected at one end of a unitary frame 14 embodying a configuration to partly encircle a person at the general area of the waistline so that at the rear of the person the unitary frame presents an upstanding rear portion to which there is pivotally connected a back pressure plate 16. Shoulder bar assemblies 18 are pivotally connected to the back pressure plate and present load bearing parts that wrap about the shoulder area of the person and present end portions used to support straps 20 that can interconnect with the abdominal plate and control the distribution of weight of the percussion instrument by the selected length of the straps 20 in combination with the pivotal interconnection between the shoulder bar assemblies 18, back plate 16 and unitary frame 14. As will be disclosed in greater detail hereinafter, the abdominal plate is provided with suitable fixtures for the attachment of any of the diverse forms of percussion instruments. The present invention further provides an improved rotator assembly and support arm arrangement for a bass drum.

Figure 2:
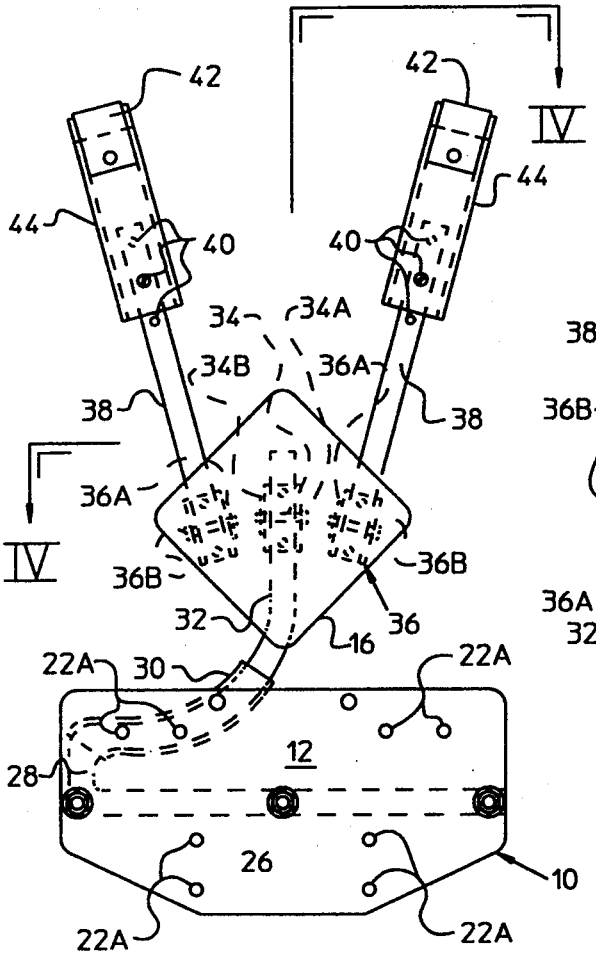
FIG. 2 is a front elevational view of the carrier shown in FIG. 1.
Figure 3:
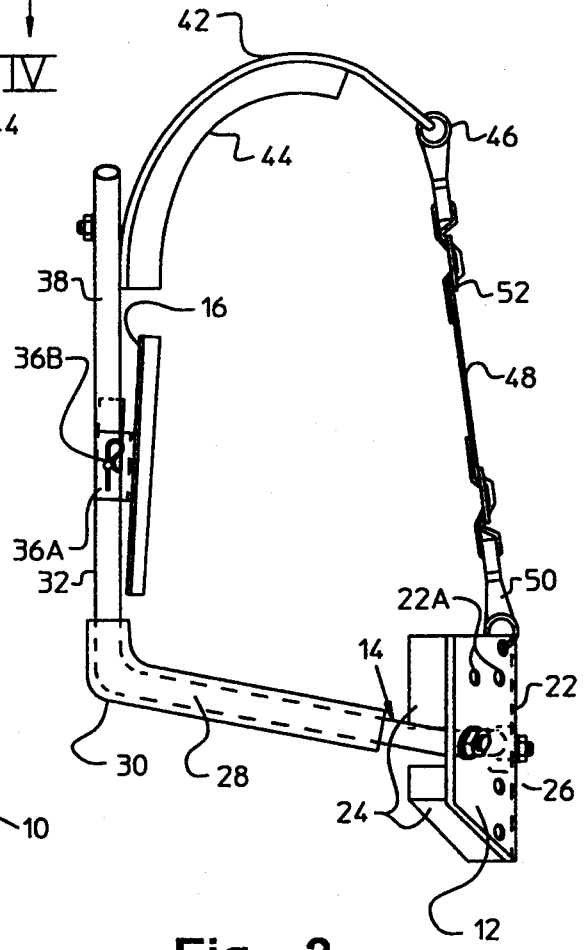
FIG. 3 is a side elevational view of the carrier shown in FIG. 2.
Figure 4:
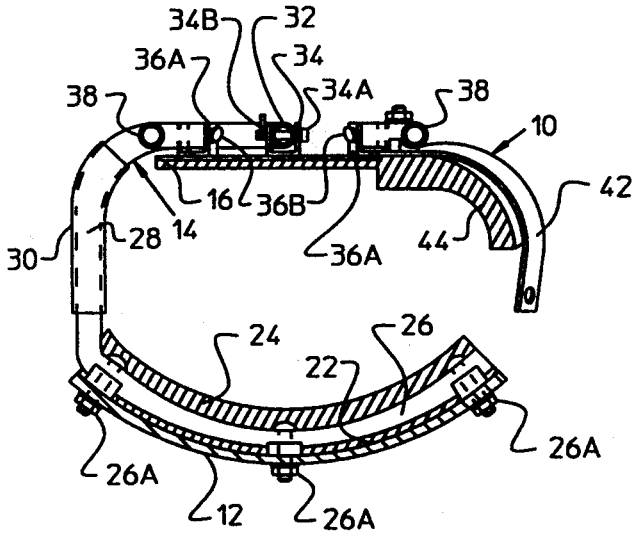
FIG. 4 is a sectional view taken along lines IB—IB of FIG. 2.

Turning now to FIGS. 2, 3 and 4 there is illustrated in greater detail the construction of the parts forming the carrier of the present invention. The abdominal plate 12 is formed with a load transferring surface 22 swept with a curvature to extend along part of the waistline of the percussionist. The curvature is uniform about the entire height of the plate, which is best seen in FIGS. 2 and 3, provides a broad diverse area where fixtures can be attached to the plate or in turn supporting a percussion instrument. For this purpose there may be conveniently provided a pattern of fasten holes 22A to facilitate the transfer of load from the curved surface of the abdominal plate directed to the abdominal area of the percussionist. There is provided a relatively thick pad 24 that is divided into parts to extend along opposite sides of a front portion 26 of the unitary frame 14. The front portion is swept with a curvature that is essentially the same as the curvature of the abdominal plate so that the bent plate lies snugly against the inside face surface of the abdominal plate. The front portion 26 is rigidly joined to the abdominal plate by threaded fasteners 26A at a site where there extends above and below the bent portion a divided part of the pad 24. The thickness of the pad 24 is greater than the distance which front portion 26 protrudes from the inside face surface of the abdominal plate so that the pad will always form the load transferring surface with the abdomen of the percussionist by precluding contact with the front portion 26. Angling from the front portion 26 is an elevated side portion 28 which is bent to slope upwardly so that where the bent portion wraps about the back of the percussionist it is situated above the skeletal structure of the pelvic region.

To maximize comfort of the percussionist when the unitary frame is made of metal, preferably a stainless steel tube, a sheeting of plastic material 30 is fitted on the elevating side portion to form a thermal barrier between the elevated side portion and the percussionist. The elevating side portion ends at a bend extending in a generally upward fashion and forming an upstanding rear portion 32 of the unitary frame 14. A clevis assembly 34 includes a pivot pin 34A extending through aligned openings in the rear portion 32 and a U-shaped clevis plate 34B. The clevis plate is rigidly affixed to back pressure plate 16 and as shown in FIG. 2 is orientated so that a corner of the back pressure plate is vertically orientated at an upper most elevation to extend in an area generally between the shoulder blades and for contact with the thoracic region at the back of the percussionist. According to the present invention, the carrier when embodying this construction and worn by a person brought about a very favorable distribution of forces when supporting a percussion instrument or the like by the functional relation of the pivotal connection between the abdominal plate 12 and back pressure plate 16. The pivotal relationship establishes a uniform load bearing contact between the face surface area of the back plate and the thoracic region of the back through the use of the abdominal plate as a fulcrum for the load applied to the percussionist by the percussion instrument and including the carrier. This relationship is maintained during normal movements of a percussionist while playing the instrument as well as seated, walking or marching as sometimes required of band members.

When the weights of the instrument and carrier represent 20% or more of the body weight of the percussionist, the present invention provides a more favorable distribution of the weight of the carrier and instrument on the percussionist body through the use of shoulder bars which, unlike my earlier developments of carriers, extend for contact with the shoulders of the percussionist from the back of the percussionist. For this purpose, at opposite lateral sides of the clevis assembly 34 there are affixed U-shaped clevis plates 36A of clevis assembly 36. Clevis pins 36B also forming part of the clevis assembly 36 are passed through aligned openings in the U-shaped clevis plates and openings in parts of extension tubes 38. The extension tubes in turn project in a somewhat outwardly diverging fashion as shown in FIG. 2 from the back plate where a series of openings 40 allow a fastener to be used to secure a bent shoulder bar 42. The bent configuration of the shoulder bar generally conforms to the curvature of the shoulder area of the percussionist. A cushion 44 is affixed to the load transferring surface of the shoulder bar to minimize impact loading. The forward most extending end terminates with an eyelet opening to which there can be received a snap fastener 46 used to connect a suitable length of belting to the abdominal plate 12 by way of a snap fastener 50. The length of the belting 48 can be varied by the use of an adjustable slide buckle 52.

In operation of the present invention the abdominal plate is positioned about the abdominal area of the percussionist so that the upwardly angling section side portion of the unitary frame partly encircles and rises upwardly from the waist area thus positioning the back pressure pad at the thoracic region of the back. The shoulder bars will swing about their pivotal connection into load bearing contact with the shoulders of the percussionist. Thereupon the belting 48 is interconnected using fasteners 46 and 50. The tension of the straps, according to the present invention, establishes a balance of pressure between the shoulder hooks and back pressure plate which will be felt on the body of the percussionist. This pressure distribution is a function of the pivotal interconnection formed by the clevis assemblies between the shoulder bars, unitary frame and back plate. The pressure distributed by these parts on the percussionist's body reduces the pressure applied by the abdominal plate. When the straps are tight, pressure can shift to the point of totality on the shoulder bars. When the straps are loose, pressure can shift to the point of totality on the back pressure plate. When the straps are at the optimum medium adjustment, pressure between shoulder hooks and back pressure plate is balanced. The articulated connection formed by the clevis assembly always allows a distribution of forces.

Figure 5:
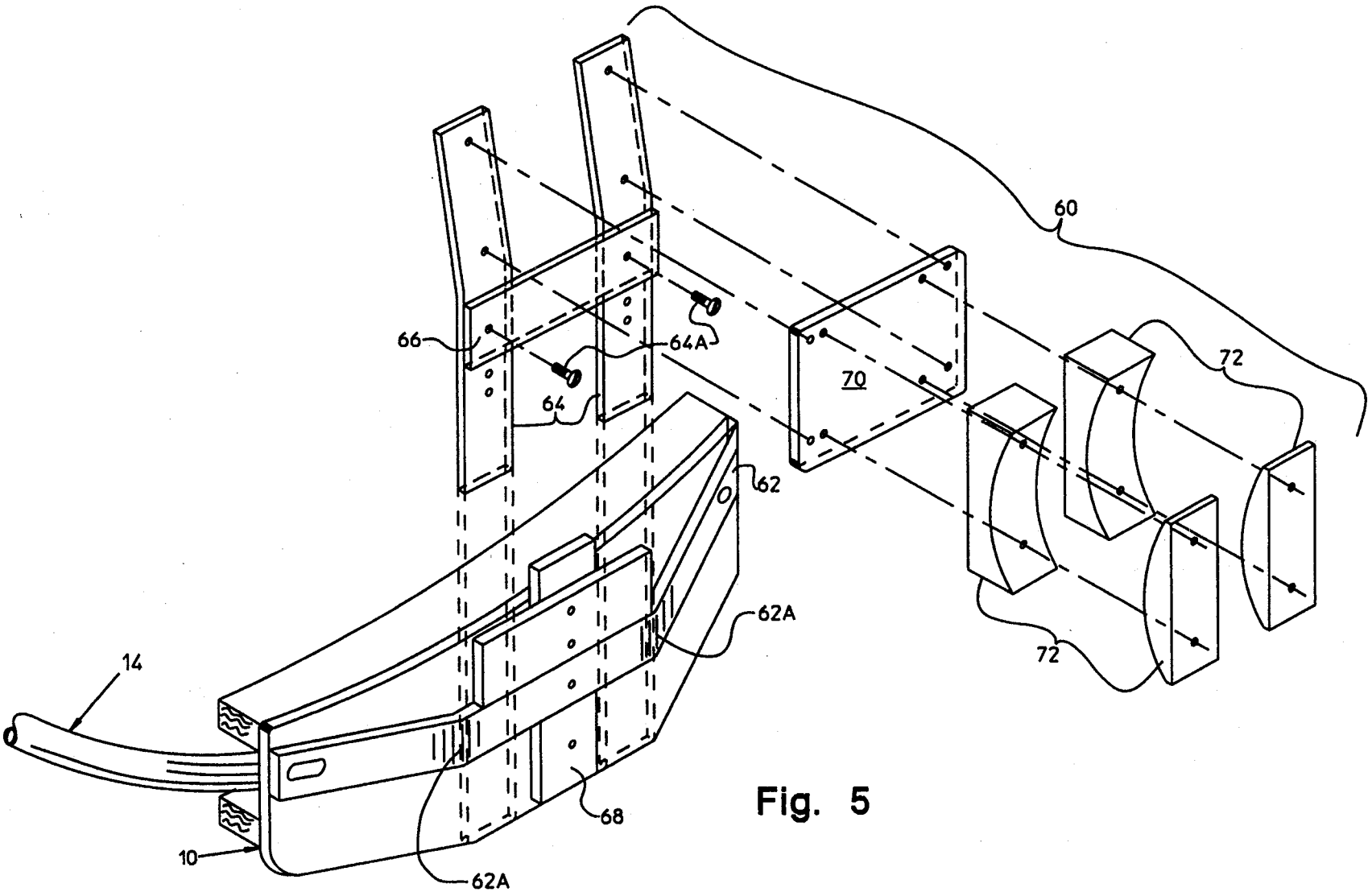
FIG. 5 is an exploded view of one embodiment of a mounting structure for a bass drum.

Turning now to FIG. 5, there is illustrated one embodiment of an arrangement of parts to form a mounting assembly 60 for supporting a bass drum on the carrier 10 for use by a percussionist. In this embodiment the bass drum is firmly affixed to the carrier while in the embodiment of FIG. 6 the bass drum can swivel with respect to the carrier while supported thereby. The mounting assembly 60 includes a retainer plate 62 that is bent along brake lines 62A so that the distance between the brake lines will accommodate upstanding spaced apart support arms 64 that are connected together by a stop bar 66 so that a gap exists between the support arms into which there is received a spacer guide bar 68. To adjust the height at which a bass drum is supported by the carrier relative to the body of the percussionist, a series of spaced apart openings is provided in the upstanding support arms 64 for securing the stop bar 66 at various heights along the support arms through the use of fasteners 64A. Since the stop bar 66 butts against the retainer plate 62 the stop bar is high on the support arms which will set deeper along the abdominal plate. Similarly, when the stop bar 66 is low on the upstanding support arms they will be held more shallow along the abdominal plate. The spacer guide bar is affixed by fasteners to the abdominal plate generally midway between the brake line 62A so that extending leg portions of the upstanding support arms 64 can pass along and be removed from opposite sides of the spacer guide bar by a guided sliding relationship. Upper end portions of the upstanding support arms 64 support a mounting plate 70 forming part of structure for mounting a bass drum to the carrier. For this purpose there is also included pairs of contour blocks 72 with each pair having conjugate curved face surfaces between which the curved shell of a bass drum is held. Fasteners such as nut and bolt assemblies are passed through openings to the contour blocks 72, mounting plate 70, and support arms 64 for mounting the bass drum.

Figure 6:
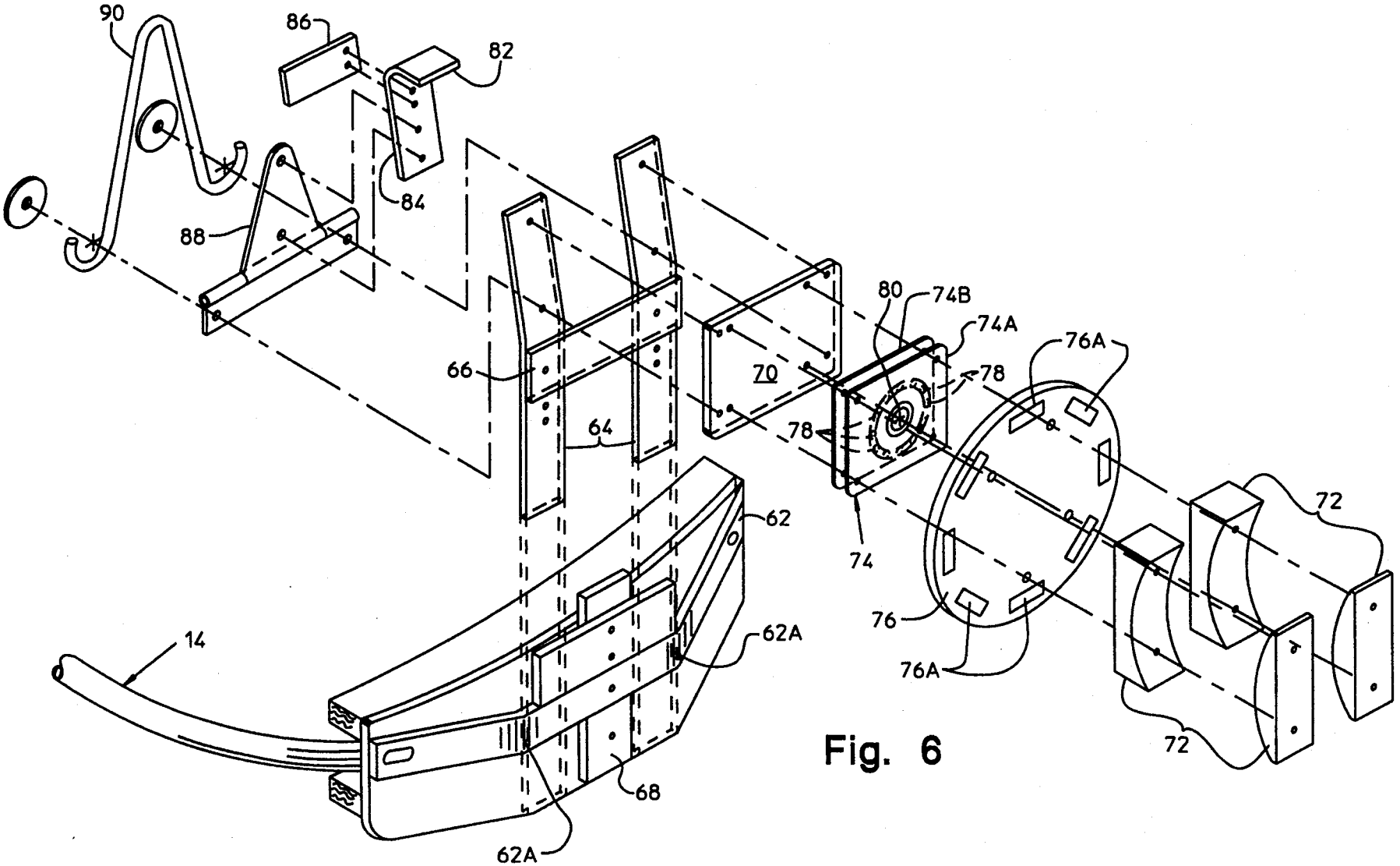
FIG. 6 is an exploded view of the second embodiment of a mounting structure that includes a swivel to allow swiveling of the bass drum during use thereof.

In the embodiment of FIG. 6 the mounting structure for the bass drum incorporates structure described according to the embodiment of FIG. 5 and additionally includes a swivel assembly 74 and a locking plate 76. The swivel assembly 74 includes spaced apart bearing plates 74A and 74B each having an annular raceway in which spheres 78 are positioned and held in place by a mounting collar 80. The bearing plate 74A is secured by fasteners passed through openings in its four corners of bearing plate 74A and similarly arranged openings in mounting plate 70 and openings in the upper portions of the upstanding support arms 64. Bearing plate 74B is provided with openings in its four corners for the passage of fasteners through an identical pattern of openings in locking plate 76 and thence through the openings in contour blocks 72. The locking plate 76 further includes index openings 76A at spaced intervals about a circle to receive a locking tongue portion 82 of a lock bar 84. The lock bar is provided with a control lever 86 for use by the percussionist to pivot the lock bar about a hinge pin forming part of a hinge 88. As shown in FIG. 6, one part of the hinge is fastened to the lower portion of lock bar 84 and the other part of the hinge is secured to the upstanding support arms so that the lock bar and its locking tongue can fit between the bars whereupon a locking tongue can pass through any one of the index opening 76A. The locking tongue is urged into the index openings by the resilient force of a spring 90 that is mounted to the face surface of the hinge which is opposite the face surface of the hinge in contact with the lock bar. The percussionist, desiring to play the bass drum while it is swinging about a rotary axis formed by the swivel, will draw with one hand the latch pin from the indexing slots and with the other hand strike the drum with the drum stick. After the lock bar is released, the force exerted by the spring 90 will apply continuous pressure to the locking tongue urging it into the next available indexing opening coming into alignment with the locking tongue. The construction allows the positioning of the bass drum in any attitude as established by the number and distribution of the index opening 76A about the locking plate 76.

The rubber lined shoulder bars relieve the downward forces due to the weight of the percussion instrument and the carrier. The upper ends of the slings attach to the forward ends of the bars, space and prevent slings from lying on the upper chest region thus preventing any restriction of the breathing function which is sometimes experienced when wearing carriers known in the art. In my earlier carrier design shown in U. S. Pat. Nos. 4,453,442 and 4,605,144, the back plate was firmly affixed to the rear vertical bar resulting in some discomfort to the player when such placement did not permit the back plate to lie flat against the thoracic region. The carrier according to the present invention provides that the back plate is attached to the vertical rear part of the frame via a clevis assembly to allow the back plate to pivot and lie flat against the thoracic region of the back regardless of the body shape and at all times during use of the carrier. This greatly increases the comfort factor of the carrier which in turn increases the load bearing capacity of the percussionist. As described previously, the frame is made of rigid steel tubing that sweeps across the belt line of the abdomen, follows the contour of one side of the body around to the back, rising gradually approximately 2", then across to the center of the back including a 90° upward arc. The gradual rise is necessary to rise above the hip bone at the back. The rear portion of the frame continues upwardly several inches. These several upward inches are drilled at intervals to accept the back plate clevis pin attachment and any height adjustment of the same necessary to fit the individual player's waist/thoracic contact surfaces relationship. The open sided frame design allows easy on/-off access and eliminates the front to rear locking device required in my earlier design. The carrier of the present invention also requires less material, weight, fewer parts and much less maintenance.

The feature of the present invention providing the extension tubes 38 used to attach the shoulder bars to the back plate also contains a series of holes along one end to allow for length adjustment. These tubes are attached to the back plate clevis assembly thereby allowing the tubes to swivel so as to form the connection between the back plate and shoulder bars without affecting contact between the back plate and the thoracic region of the back. Downward pressures of the load are distributed by the frame, back plate and extension tubes, in the rear, to the shoulder bars, and, by the slings attached to the belly plate and to the forward ends of the shoulder bars at the front. The addition of these shoulder bars dramatically increases the load bearing capacity of the carrier without adding spinal stress while almost totally relieving the perception of weight bearing on the shoulders while also eliminating breathing restrictions. The abdominal plate is attached to the front of the frame not behind it, as is the case of my earlier design, leaving the entire frontal surface of the abdominal plate for a variety of instrument attachment devices.

A comparison was made of the over-the-shoulder type carriers of other manufacture and the carrier of the present invention. Under recorded fluoroscopy with the following results: (1) the percussionist was x-rayed with no load to establish the condition of his spinal column; (2) the percussionist wore a 15 pound snare drum mounted on an over-the-shoulder type carrier, resulting in hyperextension of the spine with vertebrae compressed in the neck and lumbar regions to the extent of bone trauma and distorted discs; and (3) the percussionist wore the same 15 pound snare drum mounted on the carrier of the present invention without the extension tubes and shoulder bars. There was no spinal distortion, virtually a similar condition to "no-load", number (1) above. Experiences from the prior fixed back plate design indicates a majority of the users had localized spinal trauma due to the uneven distribution of the reactive weight-force of the percussion instrument being carried because only one of the back plate upper or lower corners, a small portion of the back plate surface, came to bear against the spinal column. With the invention of the swivel/clevis attachment of the back plate, the entire surface of the back plate is brought into contact with an equal surface of the thoracic region thereby insuring even distribution of the force applied.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A carrier worn by a person to support a percussion instrument or the like, said carrier including the combination of:

an abdominal plate having a load transferring surface swept with a curvature to extend along a part of the waist-line of such a person, a unitary frame including a front portion continued by an elevating side portion to an upstanding rear portion, said front portion being rigidly joined to said abdominal plate;

a back pressure plate for imparting to the thoracic back region of the person a reactive force in response to the weight of a percussion instrument imparted to said abdominal plate; and pivotal means interconnecting said back pressure plate and said upstanding rear portion of the unitary frame for forming a uniform load bearing contact between the face surface area of said back plate and the thoracic region of the back.

2. The carrier according to claim 1 wherein said pivotal means includes a clevis assembly.

3. The carrier according to claim 1 wherein said back pressure plate includes a cushioning layer of resilient material extending about the face surface area thereof.

4. The carrier according to claim 1 further including shoulder bar means pivotally connected to said back pressure plate for load bearing contact with a shoulder of such a person; and means linking said shoulder bar means to said abdominal plate for controlling distribution of the weight of said percussion instrument against the shoulder of such a person by said shoulder bar means and against the thoracic region by said back pressure plate.

5. The carrier according to claim 4 further including clevis means for pivotally interconnecting said shoulder bar means with said back pressure plate.

6. The carrier according to claim 4 wherein said shoulder bar means includes a pair of arcuately bent plates each having a face surface covered with a cushion for engagement with shoulder portions of the person, and an extension tube for interconnecting each of said bent plates with said back pressure plate.

7. The carrier according to claim 6 wherein said extension tubes include means to select a predetermined desired height at which said arcuately bent plates extend from said back pressure plate.

8. The carrier according to claim 4 wherein said means for controlling distribution of weight include strap member having releasable fastening means for connection with said shoulder bar means and said abdominal plate, and means for establishing a predetermined desired length of said strap member.

9. The carrier according to claim 1 wherein the front portion of said unitary frame is swept with a curvature substantially the same as the curvature of said load transferring surface, and wherein said carrier further includes fastening means to interconnect said front portion and said abdominal plate.

10. The carrier according to claim 9 wherein said load transferring surface includes a resilient pad having a thickness sufficiently greater than the thickness of said front portion to substantially prevent load bearing contact between said front portion and the person.

11. The carrier according to claim 10 wherein said resilient pad is subdivided to extend along opposite sides of said front portion.

12. The carrier according to claim 1 wherein the elevating side portion of said unitary frame rises to the height at the back of a person to preclude contact between the elevating side portion and pelvis of the person.

13. The carrier according to claim 12 wherein said unitary frame essentially consists of a bent metal tube and wherein said carrier assembly further includes means supported on said elevated side portion for thermally isolating the length of bent metal defining the elevating side portion from the body of the person.

14. The carrier according to claim 1 further including a drum mount secured for support to said abdominal plate and having removable upstanding support arms, said drum mount further including means for mounting a bass drum to said support arms.

15. The carrier according to claim 14 wherein said drum mount includes a spacer guide bar joined by a retention plate to overlie said abdominal plate at a side facing away from the waist of a person, and fastener means for securing said upstanding removable support arms relative to said abdominal plate while extending along opposite lateral sides of said spacer guide bar and extend between said abdominal plate and said retention plate.

16. The carrier according to claim 15 further including a stop bar supported by a portion of said spacer guide bar protruding above said retainer plate to establish an operative position of said upstanding support arms for support of a bass drum.

17. The carrier according to claim 15 wherein said means for mounting a bass drum includes swivel means supported by said upstanding support arms for defining a swivel axis about which said bass drum can swing, a locking plate mounted on said swivel means, means for mounting a bass drum to said locking plate, and a lock means moveable into and out of contact with said locking plate to inhibit and allow swiveling of a bass drum about said swivel axis.

18. The carrier according to claim 17 wherein said lock means includes a locking bar having a locking tongue moveable into and from index openings formed in said locking plate, hinge means for pivotally supporting said locking bar for movement of a locking tongue into and out of said index openings.

19. The carrier according to claim 18 wherein said lock means further includes means for resiliently urging said lock bar into a position where said locking tongue engages with an indexing opening of said locking plate.

20. The carrier according to claim 18 wherein said locking bar is pivotally supported by said hinge means to extend in a gap between said upstanding support arms.

21. The carrier according to claim 20 wherein said locking bar further includes a control lever secured to said lock bar for imparting a force by a person for pivotally displacing said lock bar by said hinge means.

* * * * *